United States Patent [19]

Felix

[11] Patent Number: 4,573,670

[45] Date of Patent: Mar. 4, 1986

[54] APPARATUS FOR FOLDING AND STACKING OF CONTINUOUS WEB IN ZIGZAG ARRANGEMENT

[75] Inventor: Willi Felix, Strengelbach, Switzerland

[73] Assignee: Jos. Hunkeler Ltd., Wikon, Switzerland

[21] Appl. No.: 679,232

[22] Filed: Dec. 7, 1984

[30] Foreign Application Priority Data

Dec. 7, 1983 [DE] Fed. Rep. of Germany ..... 3344260

[51] Int. Cl.[4] ..... B41L 1/32

[52] U.S. Cl. ..... 270/39; 493/413

[58] Field of Search ..... 270/39, 40; 493/413–415, 434–435

[56] References Cited

U.S. PATENT DOCUMENTS

| | | | |
|---|---|---|---|
| 3,627,306 | 12/1971 | Affupper | 493/413 |
| 3,632,103 | 1/1972 | Nikitits | 270/39 X |
| 3,697,062 | 10/1972 | Mones et al. | 493/413 |
| 3,913,904 | 10/1975 | Occhetti | 270/39 X |
| 3,917,250 | 11/1975 | Branick | 270/39 X |
| 3,972,519 | 8/1976 | Metzer | 270/30 |
| 4,074,901 | 2/1978 | Catallo | 493/413 |
| 4,406,650 | 9/1983 | Felix | 493/40 |
| 4,493,689 | 1/1985 | Affupper | 493/415 |

FOREIGN PATENT DOCUMENTS

| | | | |
|---|---|---|---|
| 2225061 | 12/1973 | Fed. Rep. of Germany | 493/435 |
| 1357816 | 3/1963 | France | 493/414 |
| 555995 | 2/1957 | Italy | 493/415 |
| 883100 | 11/1961 | United Kingdom | 270/39 |

*Primary Examiner*—E. H. Eickholt

*Attorney, Agent, or Firm*—Davis, Hoxie, Faithfull & Hapgood

[57] ABSTRACT

Apparatus is provided for folding continuous web in zigzag fashion into a stack, which apparatus is suitable for forming a stationary stack from lightweight web from below the stack. The apparatus comprises a reciprocating carriage containing guide elements forming a passage for the web to feed through the carriage as it travels. Belts running around the guide elements and anchored at both ends position the web and support the stack without tending to tear or wrinkle the web as it is being folded. A brake prevents reverse web travel.

12 Claims, 9 Drawing Figures

APPARATUS FOR FOLDING AND STACKING OF CONTINUOUS WEB IN ZIGZAG ARRANGEMENT

The present invention relates to a device for forming a stack consisting of sections, arranged on top of the other, of a web which is folded in a zigzag fashion along cross perforations or transverse folding lines which are predetermined by weakening the web where it is to fold.

BACKGROUND OF THE INVENTION

Austrian Pat. PS No. 181590 discloses a zigzag folding device for folding textile webs, that is, heavy and elastic material. In that device the web runs over drawing rolls, operating in opposite directions, which are provided in a carriage located below the stack. The driven drawing rolls pull the web and move it against the bottom surface of the stack. The rollers thus serve as feed rolls and hold the web under tension. Due to the fact that they rotate in opposite directions the drawing rolls must be mounted in the carriage in such a manner that they can be pivoted up and down to ensure that only one drawing roll is in contact with the bottom surface of the stack at any time. As thus, at all times one of the two drawing rolls is not in contact with the stack, the stack is not adequately supported in the area of the drawing rolls. At the reversing points of the carrage trave; the web detaches itself from one drawing roll and its other side is brought into contact with the other drawing roll. As the latter is driven such that it rotates continually, the web is accelerated in the instant in which it makes contact with the rotating drawing roll: this causes a shock-type tensile stress, which does not damage elastic webs but may cause damage to inelastic webs, particularly thin ones. During this change from one drawing roll to the other the web can also move backward to some extent, as it is not supported by either drawing roll during this changeover. The reverse motion of the web causes imprecise determination of the point where the fold is made. For the intended purpose of this known device, i.e., the folding of textile webs, this is not required. However, this known device is not suitable for processing without damaging them either thin webs or paper webs which have to be folded at a specific weakened line.

Furthermore, German Pat. OS No. 24 02 027 discloses a device for folding endless webs. In this device, two rotationally driven conveyor belts are located in a stationary position below an oscillating stack. An opening gap for the web is provided between these conveyor belts. Two feed rolls, serving as a feeding device, are located below this opening. The feed rolls push the web up through the opening towards a board or the bottom of the stack. The web is grasped by the conveyor belts and is then clamped between these conveyor belts and the board, or the bottom of the stack. In the extreme positions of the stack, the conveyor belts are reversed. The reversal causes the formation of undesirable wrinkles, especially in thin material. In addition, this device does not allow the formation of a fold at precisely predetermined locations, e.g., at the location of a weakened line.

OBJECTIVE OF THE INVENTION

It is the purpose of the present invention to create a zigzag folding device which is simple in construction but capable of gently folding thin webs with low tensile strength exactly at predetermined points.

SUMMARY OF THE INVENTION

In the present invention an oscillating carriage is provided with guide elements which guide and support the web beneath the stack. The guide elements, which may be rollers, are given only the task of adjusting the positioning elements. The guide elements are not rotationally driven to advance or pull the web. This makes it possible to mount the guide elements on the carriage such that they remain in position during the complete carriage stroke. A resulting advantage is that, at the reversing points of the carriage travel, the web is subjected neither to a shock-type tensile stress nor to a driving force which would tend to advance the web. The device of this invention permits both gentle folding of the web and folding at the desired points. During the movement of the carriage, the positioning elements make contact with the stack or separate from the stack. This ensures gentle feeding of thin web sections to the stack without the danger of wrinkling the web.

BRIEF DESCRIPTION OF THE DRAWINGS

A preferred embodiment is described in the accompanying purely schematic drawings.

DETAILED DESCRIPTION OF THE INVENTION

Figure 1:
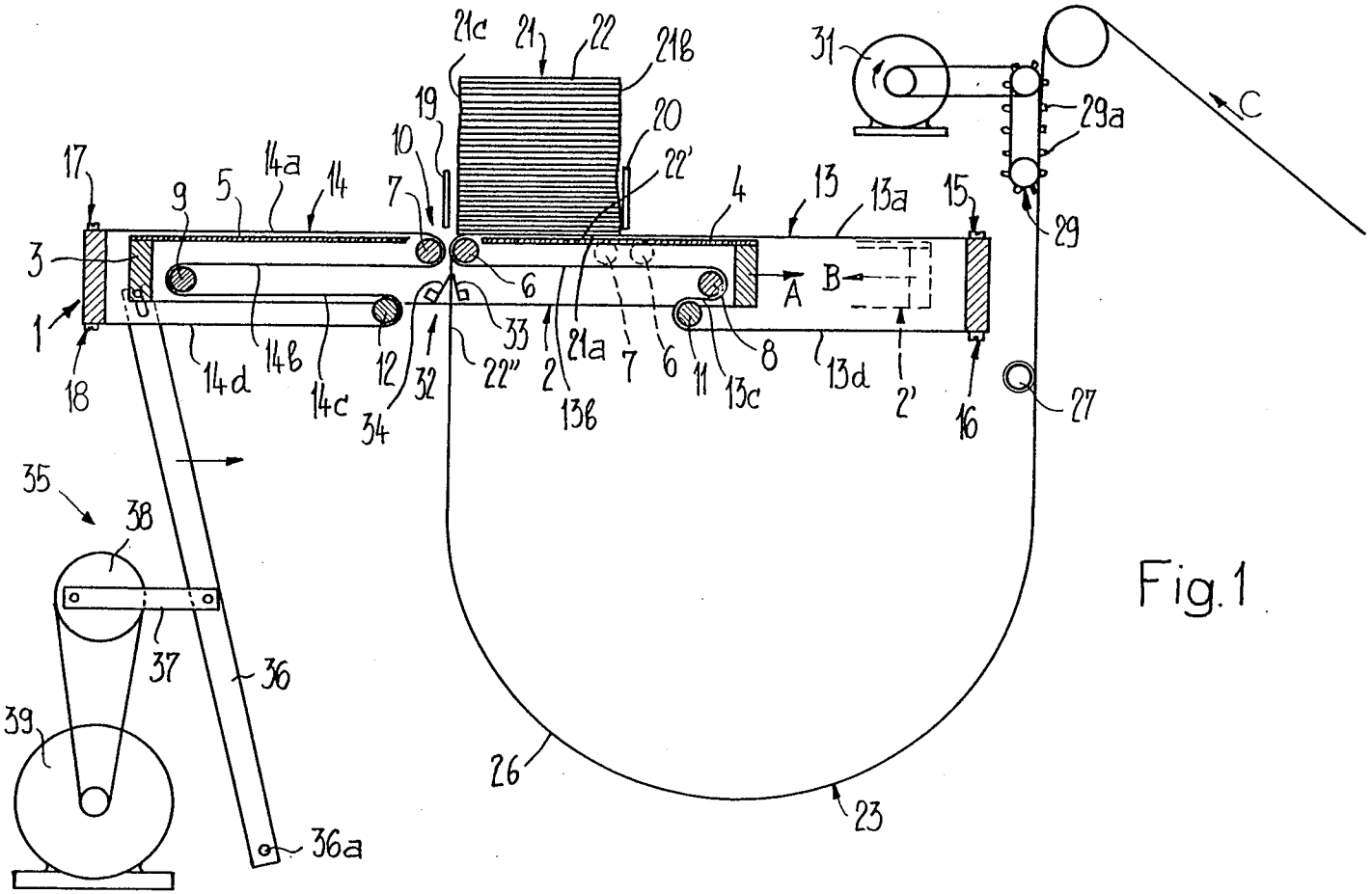
FIG. 1 illustrates an embodiment of the invention, in side elevation and in a partly sectional view with the carriage in one end position.

As illustrated, the device consists of a rack 1 which is partly shown in FIG. 1. A carriage 2 is slidably mounted on the inside of this rack in such a manner that it can slide horizontally back and forth in the directions indicated by arrows A and B. In FIG. 1, the carriage 2 is shown in its end position on the left side; the end position on the right side is indicated by the broken lines 2'. The carriage 2 comprises a frame 3 which has mounted on its top two support plates 4 and 5. These support plates 4 and 5 end at a distance from each other and thus form an opening in the middle of the carriage. In the area of the opening two guide rollers 6 and 7, freely rotatable, but fixed in their position to each other, are mounted on the inside of the carriage frame 3. Near the end of carriage 2, seen in the direction of motion A, B of carriage 2, two additional guide elements freely rotatable guide rollers 8 and 9 are mounted on the inside of the carriage frame 3. The axes of all guide rollers 6, 7, 8 and 9, mounted in the carriage frame 3, are parallel to each other and perpendicular to the direction of motion A, B of the carriage 2. The guide rollers 6 and 7 define an opening 10 which is essentially perpendicular to the direction of motion A, B of the carriage 2. Below the guide rollers 6, 7, 8 and 9 but mounted stationary with respect to rack 1 are located two additional guide elements, shown as freely rotatable guide rollers 11 and 12, with axes of rotation parallel to the axes of the guide rollers 6, 7, 8 and 9. However, the guide rollers 11 and 12, in contrast to rollers 6, 7, 8 and 9, do not move with carriage 2.

Figure 2:
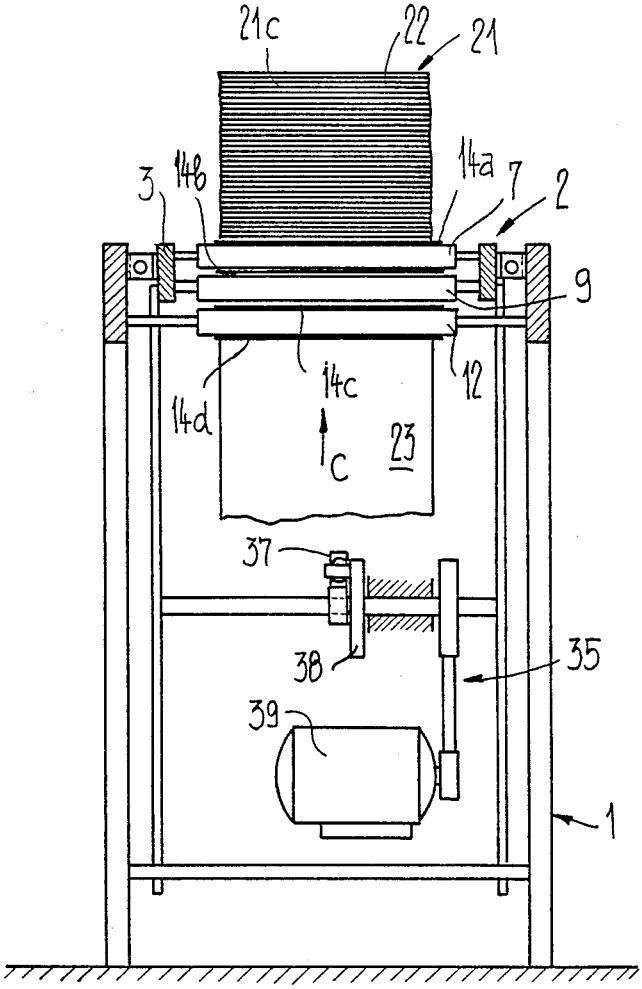
FIG. 2 illustrates the device of FIG. 1 in a front elevation and also in a partly sectional view.

Around the guide rollers 6, 8, 11 or 7, 9, 12 runs an S-shaped flexible belt 13 or 14. The wide single belt 13, 14 (see FIG. 2) could be replaced by several parallel narrower belts, which would be guided in the same fashion. The belts 13 and 14 are of finite length and anchored to the rack 1 at the points 15, 16, or 17, 18 (FIG. 1). A first section 13*a* or 14*a* of the belts 13, 14 runs from the anchoring point 15 or 17 in the direction of motion A, B of the carriage above the support plates 4 and 5 to the first guide rollers 6 or 7. A second belt section 13*b* or 14*b*, which maintains its length during the movement of the carriage, runs approximately parallel to the first belt section 13*a* or 14*a* from the first guide roller 6 or 7 to the second guide roller 8 or 9. Belt section 13*c* or 14*c* runs from the guide roller 8 or 9 to the stationary guide roller 11 or 12. The belt section between the lastly mentioned guide rollers 11 or 12 and the second anchoring point 16 or 18 bears the numeral 13*d* or 14*d*. The belt section 13*d* or 14*d* does not change in length during the movement of the carriage. The belt sections 13*c*, 13*d* and 14*c*, 14*d* also run approximately parallel to the first belt section 13*a* or 14*a*.

Figure 6:
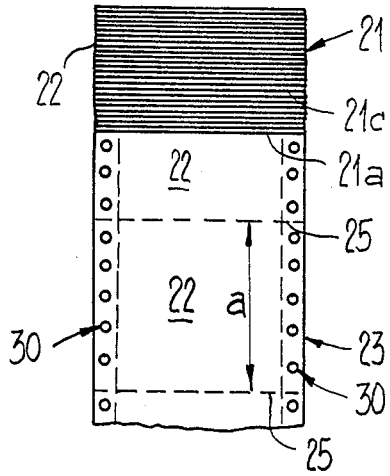

Two limit stops 19 and 20 (FIG. 1) are located above the carriage 2, which define the base for the stack 21. However, these limit stops 19 and 20 are not absolutely necessary because the motion of the carriage does not cause shifting of the stack 21, as discussed below. The stack 21, with bottom surface 21*a* and with sides 21*b* and 21*c*, is formed by the piling up of sections 22 of an continuous web 23, such as a paper web. As described later, this web is folded at folds 24. Folds 24 are predetermined by perforations 25 (FIG. 6) which run perpendicularly to the length of web 23. The cross perforations 25 are placed at equal distances along the web, each having the distance "a" from the next cross perforation. Perforations 25 are produced by methods known to those in the art and are not further discussed here. As shown in FIG. 1, the web forms a loop 26 by hanging freely through the opening 10 between the guide rollers 6 and 7. The web 23 is guided over a guide roller 27 and, by known transport means pulled in the direction of arrow C from a web supply source, such as a supply roll or a perforating mechanism, not shown here. The transport mechanism of the embodiment described here consists of two transport elements 29, of which only one is shown in FIG. 1. Each transport element comprises sprockets, designed to engage to the feed holes 30 (FIG. 6) located on each side of the web 23. Each transport element 29 is activated by a drive motor 31, preferably a stepping motor.

Below the guide rollers 6, 7 and the opening 10 for the web 23, a reverse brake 32 is located which is only shown schematically. The brake can, as shown in the drawings, be formed by two brake elements 33 and 34 which are located on opposite sides of web 23 with each lying against one side of the web 23. The reverse brake is built and adjusted in such a way that the movement of the web 23 in feeding direction C is only slightly affected by it, but that reverse movement is prevented. For example, the brake elements 33, 34 could consist of leaf-type springs, which, as illustrated in the drawings, form an acute angle with the web 23. However, these brake elements 33 and 34 can also consist of strips of material having a nap, e.g., a piece of velvet or plush, which does not provide resistance to the movement of the web 23 when the web runs with the nap, but offers resistance to a backward movement of the web 23 when it runs against the nap.

The reciprocating movement of the carriage 2 is produced by a crank drive 35. The crank drive consists of a oscillating lever 36 (FIG. 1) which pivots around its stationary axis 36*a* at one end and which at the other end engages the frame 3 of the carriage 2. This swivel lever 36 is articulated to the driving lever 37, which at its other end is eccentrically attached to the driving wheel 38. The latter is rotationally driven by a motor 39. The rotation of the driving wheel 38 causes the swivel lever to move back and forth in a known manner, which in turn drives carriage 2 in a horizontal reciprocating fashion.

Figure 3:
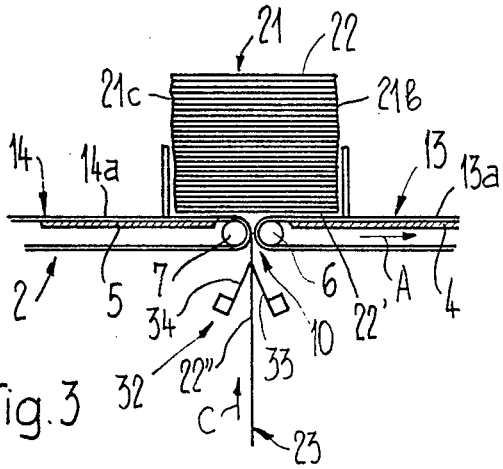
FIGS. 3 and 4 illustrate the area of the stack of the device according to FIG. 1 with the carriage in different positions.

The mode of operation of the device described above is as follows:

FIG. 1 illustrates the carriage in its end position on the left. The stack 21 is supported by the support plate 4 in this end position. The lowest section 22 of the web 23 which forms the bottom 21*a* of the stack 21, rests on the first belt section 13*a* of the flexible belt 13. The opening 10 is located outside of the bottom 21*a* of the stack, adjacent to its side 21*c*. The other belt 14 does not touch the stack 21. In this end position of carriage 2, the two belt sections 13*a* and 14*c* have their greatest length, while the belt sections 13*c* and 14*a* have their shortest length. From this left end position, the carriage 2 is now moved towards the right, as indicated by arrow A. During this movement of the carriage 2, the opening 10 moves along bottom 21*a* of the stack from outside stack side 21*c* to outside stack side 21*b*. In FIG. 3 the carriage 2 is shown in an intermediate position. During the movement of the carriage 2 from the left towards the right, belt section 13*a* progressively separates from the bottom 21*a* the stack and the length of the belt section 13*a* decreases, while the length of the belt section 13*c* increases correspondingly. Simultaneously, the belt section 14*a* makes contact with the next web section 22" and adds it—after formation of a fold 24 at the cross perforation 25—to the bottom of the stack 21, which raises the stack 21. The increase in length of the belt section 14*a* is compensated for by a corresponding decrease in length of the belt section 14*c*.

Figure 4:
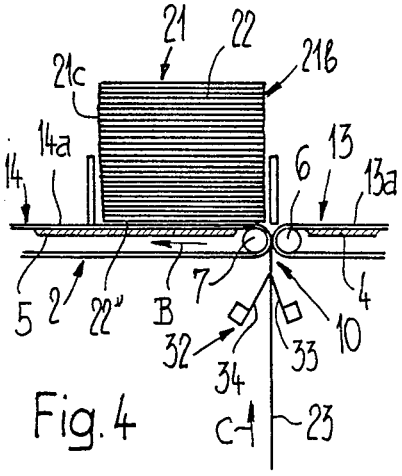
Figure 5:
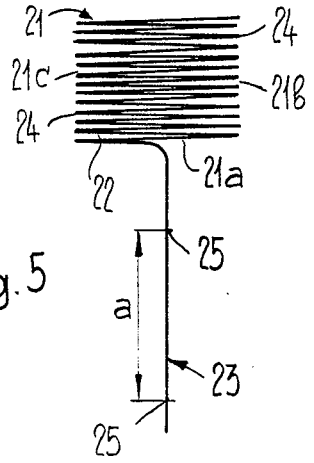
FIGS. 5 and 6 illustrate the stack and the web to be folded in side and front elevation.

In the end position of the carriage on the right, which is indicated in FIG. 1 by broken lines and also in FIG. 4, the stack is supported by the other support plate 5. The opening 10 is again located outside the bottom 21*a* of the stack and is now adjacent to the other side 21*b* of the stack 21. From this end position on the right, the carriage is now moved to the left in the direction indicated by arrow B, which causes the next web section 22 to be added, simultaneously formating another fold 24 at a cross perforation 25.

Because the belt sections 13*a* and 14*a*, as described, are either separated from the bottom 21*a* of the stack by the movement of the carriage or brought into contact with the bottom 21*a*, respectively, no force is exerted on the stack 21 in the direction of carriage movement A, B; as a result stack 21 does not move with the carriage 2, but remains stationary. Therefore, the limit stops 19 and 20 are not necessary to prevent the shifting of the stack 21 and can be omitted. Because of the reversal of the carriage 2 after it has reached its end positions, which end positions are apart by more than the distance "a" between two successive cross perforations 25 (FIG. 6) or the folds 24, zigzag-type folding of the web 23 at the predetermined points, i.e., along the cross perforation 25 and stacking of folded web sections 22 into stack 21 is achieved. During the addition of the web sections 22 the stack 21 remains always supported.

Figure 7:
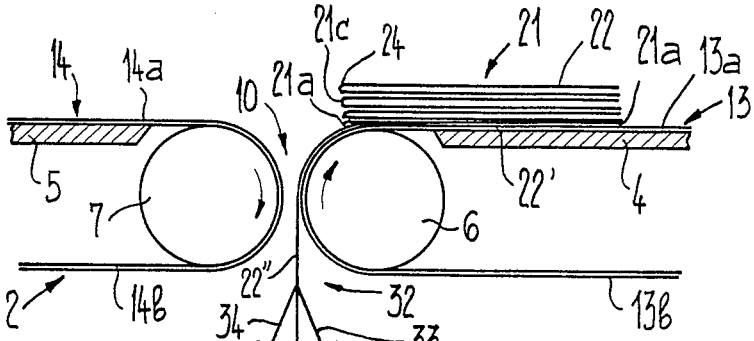
FIGS. 7–9 illustrate an enlarged view of one corner area of the stack with the carriage in different positions at the onset of a new stroke motion.
Figure 8:
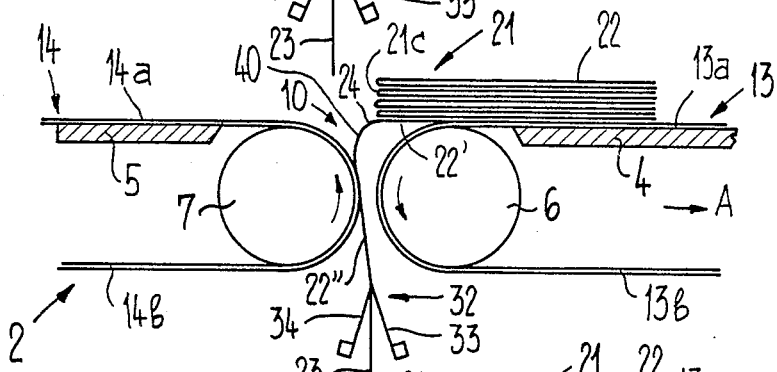
Figure 9:
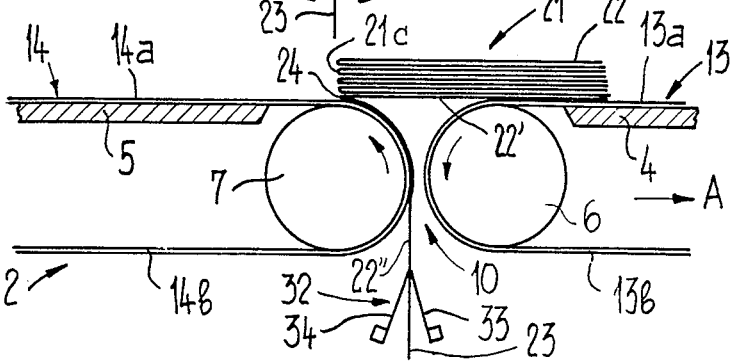

FIG. 7 to 9 illustrate the folding process which always occurs when the carriage 2 is in its end position and reverses direction. In FIG. 7, the carriage 2 is shown again in its end position at the left, in which the opening 10 is located on the left of side 21*c* of the stack which is defined by the folds 24. The web section added to the stack 21 last bears the reference number 22'. The lead part of the next following web section 22'' which will be added to the stack by the next carriage stroke runs over guide roller 6 and is bent in conformity with the curvature of the guide roller. FIG. 8 shows the carriage 2 in a position shortly after leaving the end position on the left. As is shown in FIG. 8, the web section 22'' already has separated from the guide roller 6 or, more precisely separated from the area of the belt 13 which runs over that guide roller, and is about ready to be picked up by the other guide roller 7 or, more precisely, the area of the belt 14 which runs over that guide roller. As illustrated in FIG. 8, for a short period of time, the web section 22'' is guided neither by guide roller 6 nor by guide roller 7. During this period when the web section 22'' runs freely through the opening 10, the reverse brake 32 prevents a backward motion of the web 23. Because the web 23 cannot move backwards, a bulge 40 (FIG. 8), is formed in the part of web section 22'' which has a curved shape corresponding to the preceding bending of this web section 22'' around guide roller 6. When the carriage continues its motion in the direction of the arrow A, the web section 22'' makes contact with the guide roller 7 and tends to adapt its shape. (FIG. 9). This causes the lead part of the web section 22' to be bent opposite to the shape of the bulge 40. During the continuing motion of the carriage 2 the web section 22'' makes contact with the bottom 21*a* of stack 21 with a fold 24 being formed at the location of cross perforations 25. Because the reverse brake prevents a reverse motion of the web 23 and instead causes the formation of the bulge 40, it ensures that the described addition of the next web section 22'' to the stack 21 occurs and not a separation of the preceding web section 22' from stack 21. Under certain conditions, and if a web 23 with special characteristics is folded, the reverse brake may not be necessary. However, the reverse brake 32 is required when lightweight webs are to be folded.

The advantages of the present invention can readily be seen from the preceding description. It is, i.e., possible with this device to form the stack from below. It also should be pointed out that in the beginning of the stack formation, it is necessary to apply —with the aid of any suitable means—an external pressure to the first layers of the stack. This external pressure becomes unnecessary as soon as the stack reaches a height at which, due to its own weight, stack 21 exerts the needed pressure to its base. The stacking of the web sections 22 from below makes it possible to form high stacks which are stable and do not tend to lean towards one side. Material can be taken from the top of the stack 21 while the stacking from below continues.

Changing the format, that is, forming webs with a distance other than a between adjacent perforations 25 of the web 23, can be accomplished simply by changing the stroke length of the crank drive 35. Transport elements 29 can be slaved to the crank drive. Adjustment of the feeding speed of the transport elements 29, i.e., the speed of the motor 31, can be accomplished from the crank drive by means of electric controls so that to change the format only an adjustment in the crank drive 35 is necessary.

The above described device according to the invention can accomplish the folding of web 23 and the forming of a stack 21 at high speed, even for lightweight webs.

It is understood that certain parts of the above-described device can be designed differently from the above description and drawings. Of the many possibilities, only a few will be discussed below.

In order to reduce the friction between the support plates 4 and 5 and the belt sections 13*a* and 14*a* during the movement of the carriage 2, one can create an air cushion between the support plates 4 and 5 and the belt sections 13*a* and 14*a*. This, i.e., can be accomplished by providing holes in the support plates 4 and 5 through which air can be blown between the top of the support plates 4 and 5 and the belt sections 13*a* and 14*a*.

The guide rollers 11 and 12 do not necessarily have to be rotatable. If the other guide rollers 6, 7, 8 and 9 were not rotatably mounted, the belts 13 and 14 would have to slide over these rollers, which would have disadvantages.

The fact that the web 23 hangs freely below opening 10 in the form of a loop 26, ensures a sufficient web supply to permit satisfactory operation of the folding and stacking process, even if the web feed is discontinuous. The sag of the loop 25 can, if desired, be regulated by known control means, for example, by dancer roll control.

Instead of guiding the belts 13 and 14 over the guide rollers 11 and 12, and anchoring them at the points 16 and 18 to the rack 1, it is possible to anchor the belts 13 and 14 to the guide rollers 11 and 12 and to attach tensioning straps between the latter and the anchoring points 16 and 18. The tensioning straps can be stretched by means of a tensioning mechanism, that, through the guide rollers 11 and 12, also maintain tension in the belts 13 and 14. In other words, in this embodiment, the belt sections 13*d* and 14*d* are replaced by tensioning straps separated from the belts 13 and 14.

The above described device is suitable not exclusively but in particular for folding paper webs, which had previously been run through a printer of the type used in data processing systems, which operate at high speed.

Even though the described device is particularly useful for adding web sections to the bottom of the stack, it is also possible to guide the web from the top down and to form a zigzag fold in a corresponding manner, with the web sections being added to the stack from the top.

I claim:

1. Apparatus for producing a stack of zigzag folded web sections from a continuous web of material having predetermined fold lines at which the web is weakened, comprising:

a rack;

a carriage movable between two end positions in reciprocal fashion in said rack;

an opening through the carriage oriented essentially perpendicular to the reciprocal motion of the carriage for the passage of web through the carriage;

said end positions being located to permit movement of said opening from one side of the produced stack to the other side of the produced stack;

guide elements fixedly mounted in said carriage at the side adjacent said stack to define said opening;

a positioning element of flexible material extending from said rack across the side of the carriage adjacent said stack, in the direction of travel of the carriage, to and around the nearest of said guide elements;

each of said positioning elements bending around its associated guide element to separate progressively from the last web section added to the stack as the carriage moves in a first direction and to add a next web section to the stack as the carriage moves in a second direction opposite to said first direction; and drive means for driving said carriage between said end positions in reciprocal fashion.

2. Apparatus according to claim 1 wherein said guide elements are rollers.

3. Apparatus according to claim 1 wherein said carriage is below said stack and serves as a support therefor.

4. Apparatus according to claims 1,2 or 3, wherein said positioning elements comprise at least one flexible belt having a first section extending from an anchor point on said rack and contacting the bottom of said stack.

5. Apparatus according to claim 4 wherein said flexible belts extend from said positioning elements back to a second anchor points on said rack, further comprising equalizing means to maintain a constant belt length during reciprocal travel of said carriage.

6. Apparatus according to claim 5 wherein each of said equalizing means comprises a second guide element, parallel to said first guide element, mounted in said carriage and a third guide element, parallel to said first guide elements, mounted in said rack, and wherein each of said flexible belts extends from said first anchor point to and around said first guide element, then in approximately reverse direction to and around said second guide element, then in approximately reverse direction to and around said third guide element and finally, again reversing direction, to said second anchor point.

7. Apparatus according to claims 1, 2 or 3 further comprising a reverse brake mounted in said carriage to prevent reverse movement of said web.

8. Apparatus according to claim 7 wherein said reverse brake comprises a pair of brake elements capable of punching said web to prevent reverse travel.

9. Apparatus according to claims 3 further comprising support plates mounted on said carriage beneath said positioning elements adjacent said stack to provide support for said stack.

10. Apparatus according to claim 9 further comprising means for providing a gaseous cushion between said support plates and said positioning elements adjacent said stack.

11. Apparatus according to claims 1, 2 or 3 wherein said drive means comprises crank means.

12. Apparatus according to claims 1, 2 or 3 further comprising transport means for advancing said web to said carriage.

* * * * *